US006201767B1

(12) United States Patent
Lagace et al.

(10) Patent No.: US 6,201,767 B1
(45) Date of Patent: Mar. 13, 2001

(54) ADJUSTABLE IN-HULL TRANSDUCER ASSEMBLY

(75) Inventors: Maurice Lagace, Peterborough; Robert Cullen, Temple, both of NH (US)

(73) Assignee: Airmar Technology Corporation, Milford, NH (US)

( * ) Notice: Subject to any disclaimer, the term of this patent is extended or adjusted under 35 U.S.C. 154(b) by 0 days.

(21) Appl. No.: 09/163,706

(22) Filed: Sep. 30, 1998

(51) Int. Cl.[7] ..... H04R 1/02
(52) U.S. Cl. ..... 367/173
(58) Field of Search ..... 367/173, 165, 367/188; 381/388, 389; 310/337

(56) References Cited

U.S. PATENT DOCUMENTS

| | | | | |
|---|---|---|---|---|
| 2,602,101 | | 7/1952 | Mesh . | |
| 2,728,901 | * | 12/1955 | Millen | 367/173 |
| 3,753,219 | * | 8/1973 | King, Jr. | 367/173 |
| 3,938,372 | | 2/1976 | Sproule | 73/67.8 |
| 4,282,590 | | 8/1981 | Wingate | 367/104 |
| 4,534,307 | | 8/1985 | Overs | 114/343 |
| 4,938,165 | | 7/1990 | Williams et al. | 114/343 |
| 5,142,497 | | 8/1992 | Warrow | 367/12 |
| 5,186,050 | | 2/1993 | Lagace et al. | 73/187 |
| 5,526,765 | | 6/1996 | Ahearn | 114/343 |
| 5,581,515 | | 12/1996 | Masreliez | 367/89 |
| 5,697,319 | | 12/1997 | Steensland et al. | 114/357 |

FOREIGN PATENT DOCUMENTS

| | | | |
|---|---|---|---|
| 2730116 | * | 1/1979 | (DE) . |
| 2730117 | * | 1/1979 | (DE) . |
| 2 577 341 | | 11/1985 | (FR) . |

* cited by examiner

*Primary Examiner*—Daniel T. Pihulic
(74) *Attorney, Agent, or Firm*—Hamilton, Brook, Smith & Reynolds, PC

(57) ABSTRACT

A transducer assembly for mounting to an interior surface of a hull includes a base for securing the assembly to the interior surface of the hull. A mounting member for mounting to the base is rotatably positionable relative to the base about a rotational axis. A transducer element is secured to the mounting member for generating soundwaves that travel in an acute angular direction relative to the rotational axis. Rotation of the mounting member relative to the base about the rotational axis changes the direction of travel of the soundwaves. A retaining device locks the mounting member in place relative to the base.

21 Claims, 8 Drawing Sheets

ADJUSTABLE IN-HULL TRANSDUCER ASSEMBLY

BACKGROUND

Many watercraft are provided with an electronic sonar system such as a depth finder or a fish finder. These systems usually include a disc shaped piezoelectric transducer element acoustically coupled to the surrounding water for generating soundwaves in the water. Typically the transducer element is mounted to the inside surface of the hull for protection, or extends into the water either through a hole in the hull or from a bracket on the stern of the hull. In each mounting arrangement, the transducer element is preferably aimed vertically downwardly into the water for optimum performance.

Transducer elements which are mounted inside the hull are typically enclosed within a housing bonded to the interior surface of the hull. The transducer element is encapsulated and suspended within the housing with potting material. The transducer element is oriented relative to the housing in a manner to aim the transducer element vertically downward. The bottom of the housing is sometimes angled to approximately match the hull deadrise angle so that a wedge-shaped region of potting material is formed between the transducer element and the bottom of the housing.

SUMMARY OF THE INVENTION

The problem with such a mounting arrangement is that hulls of different styles of watercraft commonly vary in angle from about 0 degrees to about 22 degrees. As a result, a transducer housing designed for one particular hull style (or angle) is usually not suitable for installation in other hull styles because the transducer element does not get aimed in the direction which provides a vertical soundbeam for optimum performance.

The present invention is directed to a transducer assembly which can be mounted to the interior surface of a hull of any standard hull without sacrificing performance. The transducer assembly of the present invention includes a base for securing the assembly to the interior surface of the hull. A mounting member for mounting to the base is rotatably positionable relative to the base about a rotational axis. A transducer element for generating soundwaves is secured or fixed to the mounting member in an orientation such that soundwaves generated by the transducer element travel in an acute angular direction relative to the rotational axis. Rotation of the mounting member relative to the base about the rotational axis changes the direction of travel of the soundwaves.

In preferred embodiments, a retaining device or member locks the mounting member and transducer element in place relative to the base once the optimum position of the transducer element is determined. The transducer element is preferably locked in place so that the direction of travel of the soundwaves is vertically downward into the water. The base forms an outer housing including a generally cylindrical tube extending along the rotational axis and has an angled mounting surface for securing to the interior surface of the hull. The mounting member forms an inner housing including a generally cylindrical tube which extends along the rotational axis. The inner housing has an angled end wall to which the transducer element is acoustically coupled. A portion of the inner housing extends within the outer housing. The transducer element is surrounded within the inner housing with potting material. An acoustic coupling medium is positioned between the outer housing and the inner housing for acoustically coupling the inner housing to the hull. The inner housing includes a flange for securing the inner housing to the retaining device. The retaining device includes protrusions for engaging with recesses in the outer housing for locking the retaining device to the outer housing. The inner housing preferably includes alignment markings for aligning the inner housing in proper rotational position with the outer housing for a given hull deadrise angle. The outer housing also preferably includes alignment markings for aligning the outer housing in proper rotational position relative to the hull.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
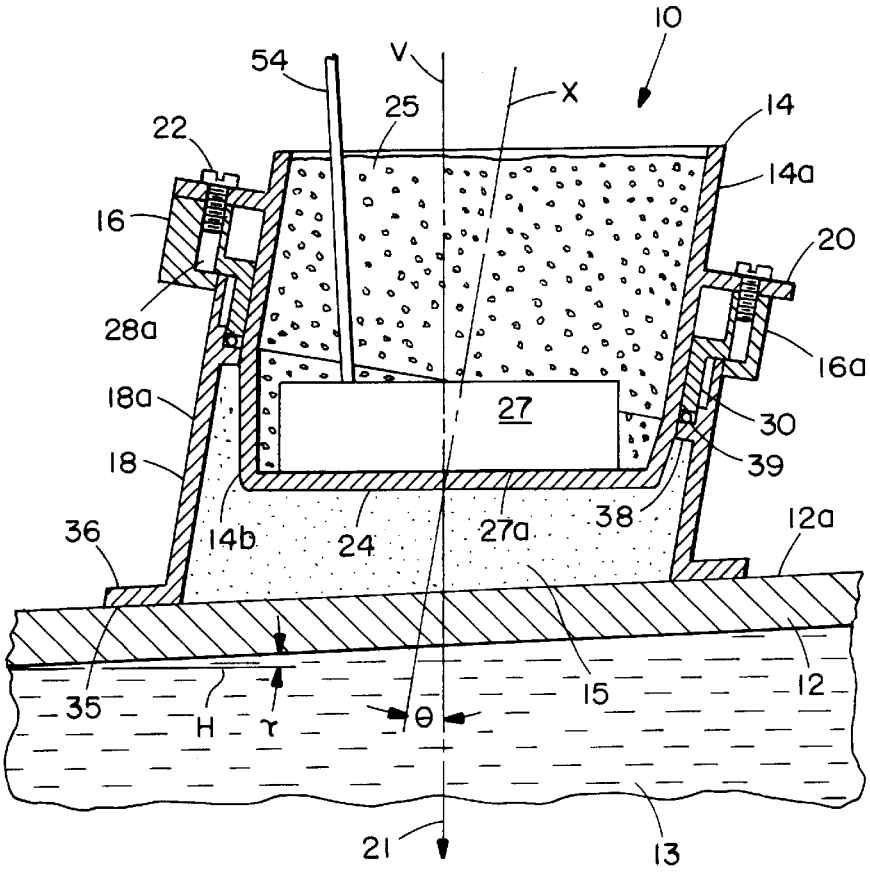
FIG. 1 is a side sectional view of the present invention transducer assembly mounted to the interior surface of a watercraft hull.
Figure 2:
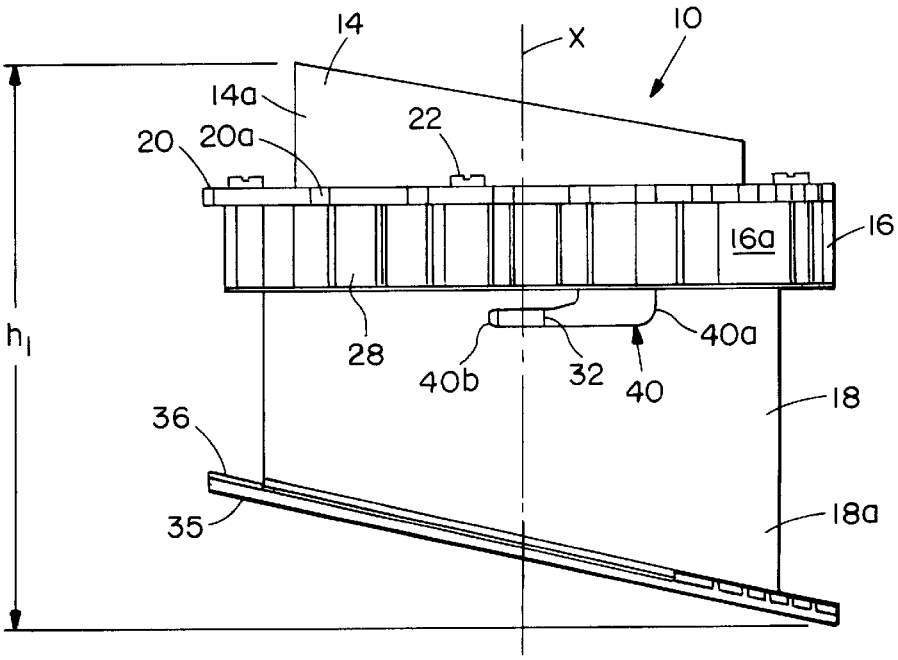
FIG. 2 is a side view of the present invention transducer assembly.
Figure 3:
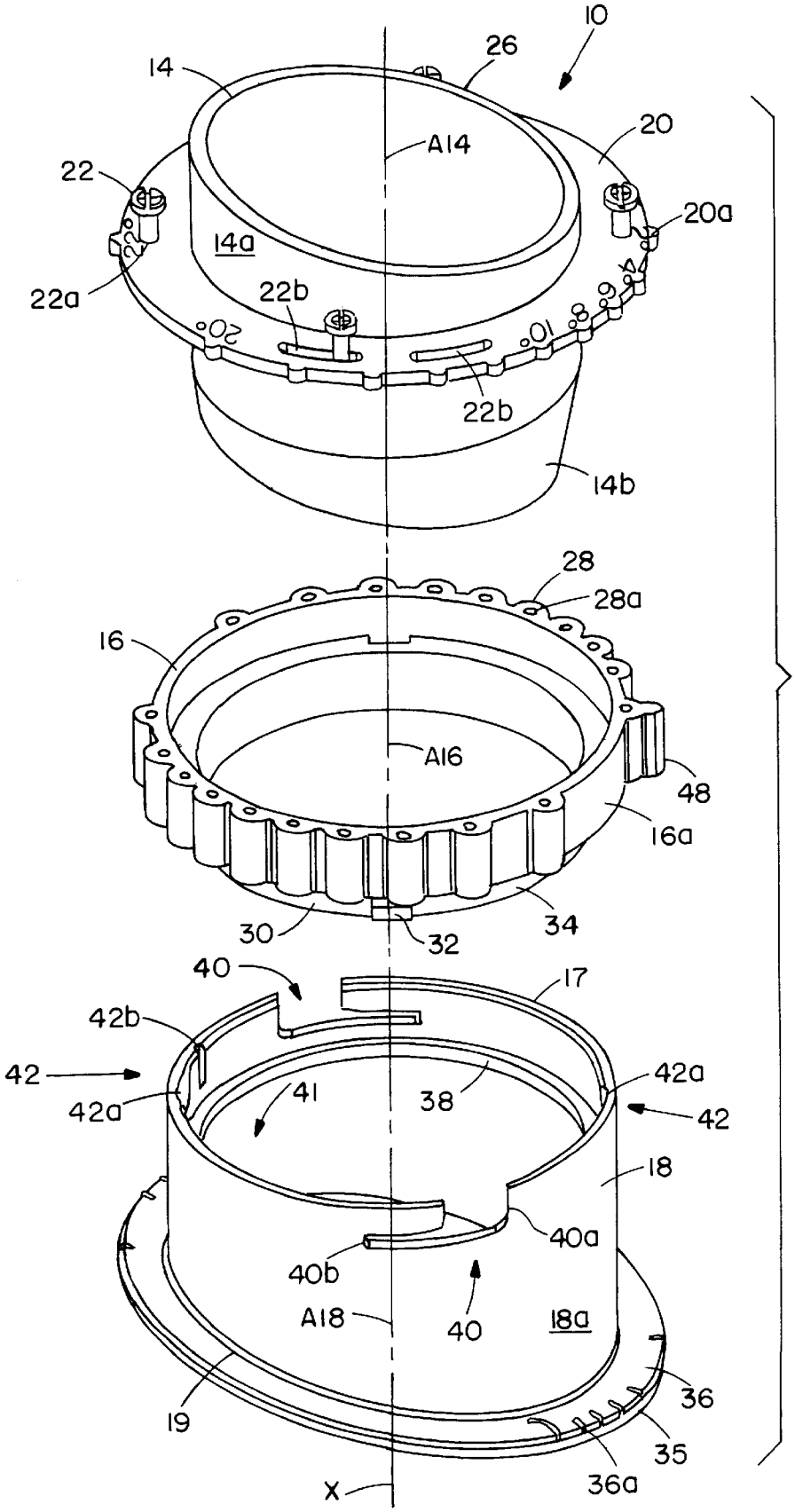
FIG. 3 is an exploded view of the transducer housing assembly.

Referring to FIGS. 1–7, transducer assembly 10 mounts to the interior surface 12*a* of a hull 12 and includes an outer base housing 18 having an angled mounting surface 35, an inner transducer housing 14 positioned or nested within outer housing 18, an annular retaining member 16 for locking inner housing 14 to outer housing 18, and a transducer element 27 (FIG. 1) positioned within inner housing 14 for generating soundwaves. Inner housing 14 includes a flange 20 encircling the perimeter thereof which is secured to retaining member 16 with screws 22 extending through holes 22*a* and slots 22*b* within flange 20 and into threaded holes 28*a* within retaining member 16 (FIG. 3). Retaining member 16 is secured to outer housing 18 by a pair of retaining tabs 32 and protrusions 33 extending from retaining member 16 (FIG. 6) which engage with corresponding retaining notches 40 and locking recesses 42 within outer housing 18 (FIG. 3). The axis A14 (FIG. 3) of inner housing 14, the axis A16 of retaining member 16 and the axis A18 of outer housing 18 all coincide along a common axis X when assembled. Transducer element 27 has a bottom surface 27*a* which is bonded to the bottom wall 24 of inner housing 14 (FIG. 1). A potting material 25 encapsulates transducer element 27 within inner housing 14. A cable 54 extending from transducer element 27 electrically connects transducer element 27 with remotely located electronics. The region between the bottom of inner housing 14 and hull 12 is occupied by an acoustic coupling fluid 15 which acoustically couples the bottom wall 24 of the inner housing 14 to hull 12, thereby acoustically coupling the transducer element 27 to the surrounding water 13. An "O" ring 39 is positioned between the neck 30 of retaining member 16 and shoulder 38 of outer housing 18 to prevent leakage of the acoustic coupling fluid 15.

Transducer element 27 is positioned within inner housing 14 by bottom wall 24 of inner housing 14 at an orientation such that surface 27*a* of transducer element 27 faces and directs soundwaves in a direction 21 that is at an acute angle θ relative to axis X(FIG. 1). The direction 21 of the soundwaves is preferred to be along the vertical axis V relative to the horizontal plane H of water 13. Typically, the location of the hull 12 upon which transducer assembly 10 is mounted, extends at a deadrise angle γ relative to the horizontal plane H of water 13. The direction 21 of soundwaves generated by transducer element 27 can be aimed vertically downward into the water 13 along vertical axis V (as shown in FIG. 1) by the proper rotational positioning of inner housing 14 relative to outer housing 18 in combination with the proper rotational positioning of outer housing 18 relative to hull 12. Once outer housing 18 is in proper position, there is at least one rotational position of inner housing 14 and retaining member 16 relative to outer housing 18 where the angle θ of the soundwaves compensates for the hull deadrise angle γ and orients the surface 27*a* of transducer element 27 parallel to horizontal plane H so that the direction 21 of soundwaves generated by transducer element 27 is the same as the vertical axis V. Inner housing 14, therefore, can be positioned relative to outer housing 18 to aim the transducer element 27 vertically downwardly into the water 13 for a typical range of hull deadrise angles γ.

A series of hull deadrise angle markings 36*a* (FIG. 5) corresponding to a number of different hull deadrise angles are positioned along flange 36 of outer housing 18 for aiding in the proper rotational positioning of outer housing 18 relative to hull 12. The location of each hull angle marking 36*a* on flange 36 is calculated to help orient the transducer element 27 in a rotational position relative to hull 12 to partially compensate for the hull deadrise angle γ. Flange 20 of inner housing 14 includes a series of rounded protrusions 20*a* (FIG. 3) positioned around the circumference of flange 20 with the same hull deadrise angle markings for alignment with pointer 48 of retaining member 16. Aligning pointer 48 with the appropriate hull deadrise angle marking on flange 20 ensures the proper rotational positioning of inner housing 14 relative to outer housing 18 to complete the compensation for the hull deadrise angle γ so that transducer element 27 is aimed along the vertical axis V. Flange 36 of outer housing 18 also includes orientation markings 36*b* for aiding in the proper orientation of outer housing 18 relative to the keel of the watercraft's hull 12.

In order to install transducer assembly 10 within a watercraft, the location on the interior surface 12*a* (FIG. 1) of the hull 12 is first chosen and a center line is drawn on the interior surface 12*a* perpendicularly to the keel. The hull deadrise angle γ at that location is then measured. Pointer 48 (FIG. 3) on retaining member 16 is aligned with the appropriate hull deadrise angle marking on flange 20 of inner housing 14 which corresponds to the measured hull deadrise angle. Inner housing 14 is then secured to retaining member 16 with screws 22 extending through holes 22*a* and slots 22*b* in flange 20 and into threaded holes 28*a* within retaining member 16. Next, outer housing 18 is aligned relative to the center line drawn on the hull by matching the appropriate hull deadrise angle markings 36*a* on flange 36 (FIG. 5) with the centerline while keeping the orientation markings 36*b* generally pointing in the direction of the keel. This rotationally positions outer housing 18 relative to hull 12 to partially compensate for the hull deadrise angle γ. Further compensation for angle γ is provided by the rotational position of inner housing 14 relative to outer housing 18 and hull 12. Bonding material is applied to the mounting surface 35 of flange 36 and outer housing 18 is pressed firmly in place. When the bond is cured, a quantity of acoustic coupling fluid is poured into outer housing 18. "O"-ring 39 is installed in the interior of outer housing 18 above shoulder 38. The inner housing 14 and retaining member 16 assembly is lowered into outer housing 18 and secured to outer housing 18 by engaging the retaining tabs 32 and protrusions 33 of retaining member 16 with the retaining notches 40 and locking recesses 42 of outer housing 18. Once retaining member 16 is locked in place, transducer element 27 is aimed along vertical axis V.

A more detailed description of transducer assembly 10 now follows. Outer housing 18 includes a hollow cylindrical portion 18*a* extending along axis A18 (FIGS. 3 and 4) with a squared off or perpendicular end 17 and an angled end 19 being at an angle Φ relative to end 17. The angle Φ partially compensates for the hull deadrise angle γ of hull 12 when installed. Mounting flange 36 is annular in shape and extends radially outwardly from end 19. The lower surface of mounting flange 36 serves as the mounting surface 35. End 17 of cylindrical portion 18*a* includes a pair of opposed retaining slots 40 (FIG.3) formed therethrough as well as a pair of opposed locking recesses 42 located on the inner surface of cylindrical portion 18*a* and preferably positioned about 90° away from retaining slots 40. Retaining slots 40 include an entrance portion 40*a* for axial entry and a narrow retaining portion 40*b* laterally offset from the entrance portion 40*a* for preventing axial movement. The locking recesses 42 include a clearance portion 42*a* and a locking portion 42*b* which are spaced apart from each other. Shoulder 38 extends along the inner surface of cylindrical portion 18*a* just below retaining slots 40 and locking recesses 42.

Retaining member 16 (FIGS. 3 and 6) includes an annular outer ring portion 16*a* and an annular neck portion 30 positioned along central axis A16. Neck portion 30 extends from and has a smaller outer diameter than outer ring portion 16*a*. Neck portion 30 fits within cylindrical portion 18*a* of outer housing 18 and engages the inner surface of cylindrical portion 18*a*, extending almost to shoulder 38. Outer ring portion 16*a* includes a shoulder 34 which abuts end 17 of outer housing 18. Retaining tabs 32 extend from opposite sides of neck portion 30 and allow retaining member 16 to be secured to outer housing 18 by axial insertion through the entrances 40*a* of retaining slots 40 and then twisting retaining member 16 so that the retaining tabs 32 slide into the narrow retaining portions 40*b*. Protrusions 33 (FIG. 6) extend from opposite sides of neck portion 30 and are preferably positioned about 90° away from locking tabs 32 for engaging the locking portions 42*b* of recesses 42 to further secure or lock retaining member 16 in place. The clearance portions 42*a* of locking recesses 42 allow neck portion 30 of retaining member 16 to be initially inserted into the interior of inner housing 18 without significant interference of protrusions 33 with cylindrical portion 18*a*. A series of bosses 28 extend along the exterior perimeter of upper ring portion 16*a* with each boss 28 having a threaded hole 28*a* therein. Additionally, pointer 48 extends from one boss 28 (FIG. 3).

Inner housing 14 (FIGS. 3 and 7) includes a hollow cylindrical portion 14*a* extending along axis A14. Flange 20 is annular in shape and encircles the outer perimeter of cylindrical portion 14*a* in perpendicular relation to axis A14. Cylindrical portion 14*a* has an upper lip 26 which is at an angle ⊖ relative to flange 20. A lower tapered portion 14*b* extends from cylindrical portion 14*a* and terminates at bottom wall 24. Bottom wall 24 is also at the angle ⊖ relative to flange 20 and is therefore parallel to rim 26. As a result, when transducer element 27 is bonded to bottom wall 24, the direction 21 of soundwaves generated by transducer 27 is at an acute angle θ relative to axis X.

Transducer element 27 is preferably disc shaped and formed from piezoelectric ceramic material. If needed, vibration isolation material can be placed around the appropriate surfaces of transducer element 27. Inner housing 14, retaining member 16 and outer housing 18 are preferably molded from plastic, but alternatively, can be made of other suitable materials such as metal or ceramics. Potting material 25 is preferably epoxy resin but can be other suitable potting materials. Although mineral oil is the preferred acoustic coupling fluid, other suitable acoustic coupling fluids can be employed such as other oils, water, antifreeze etc. Also, potting material 25 can be employed as the acoustic coupling medium.

Figure 4:
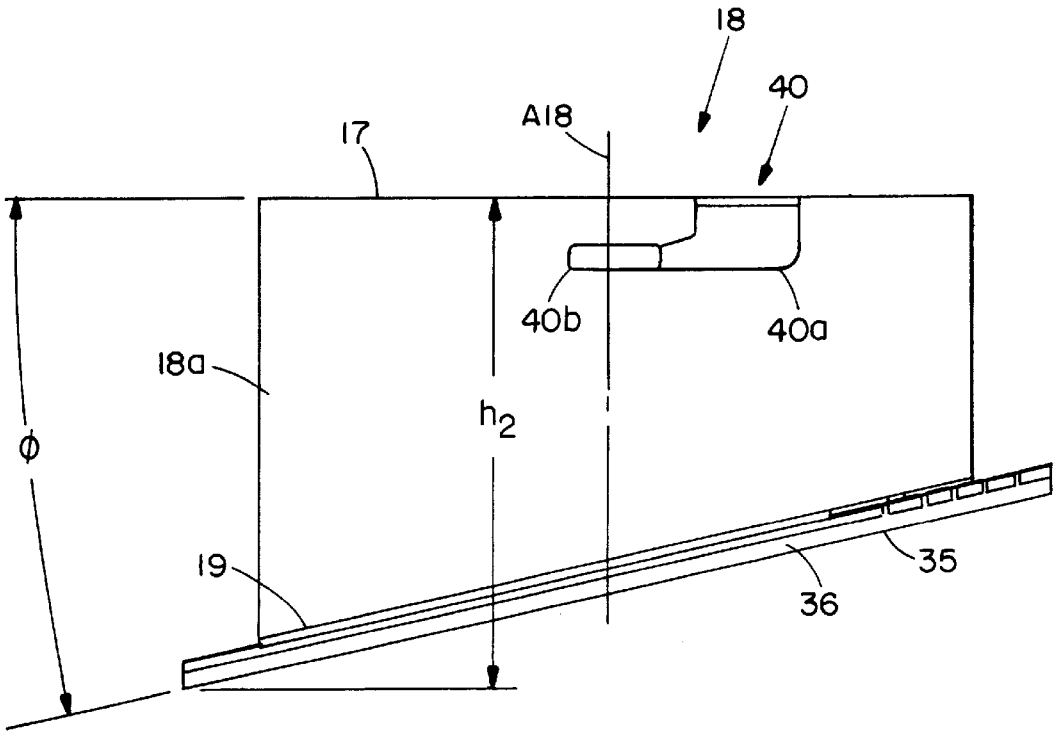
FIG. 4 is a side view of the outer housing.
Figure 5:
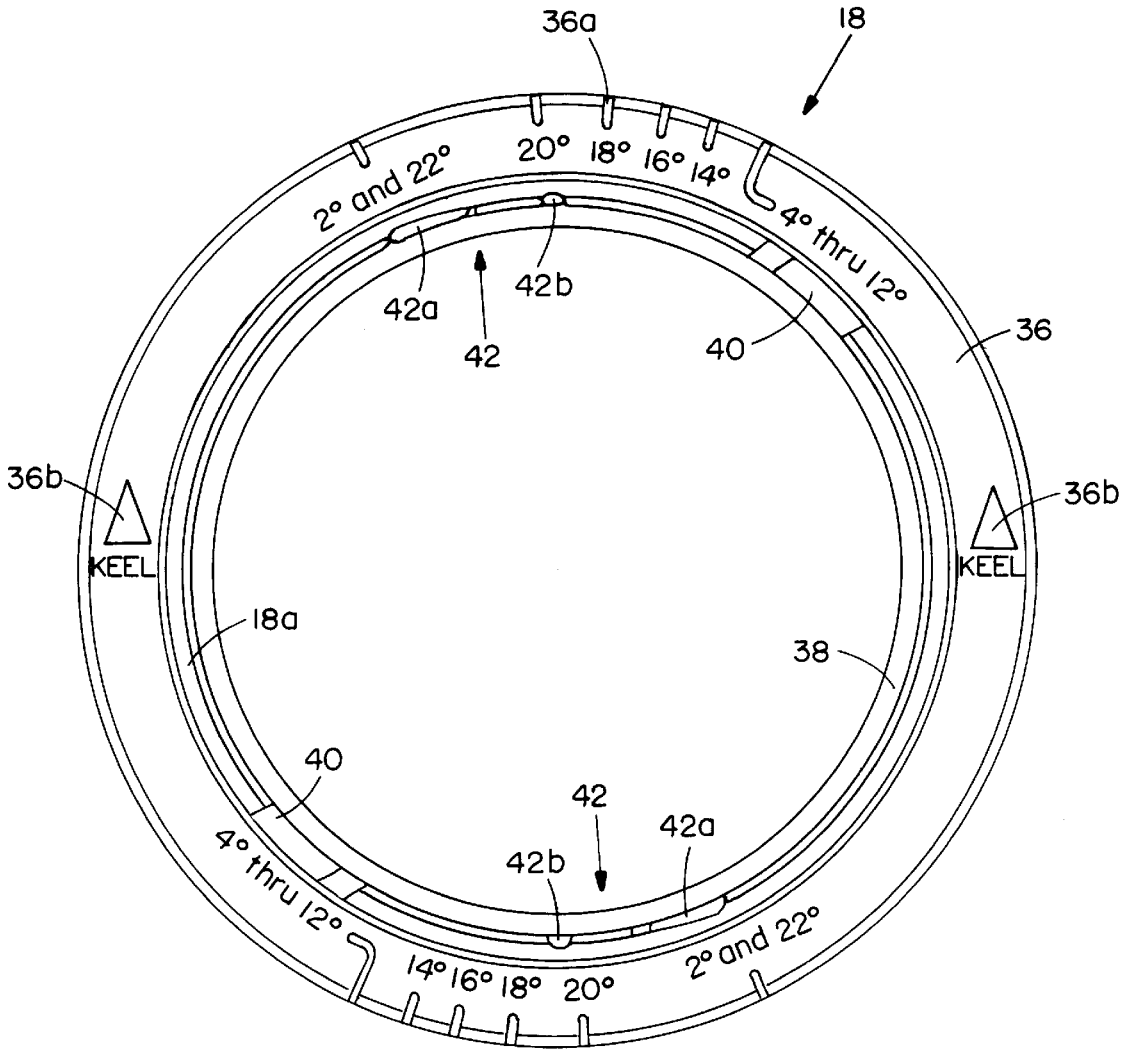
FIG. 5 is a top view of the outer housing showing hull angle and alignment markings.
Figure 6:
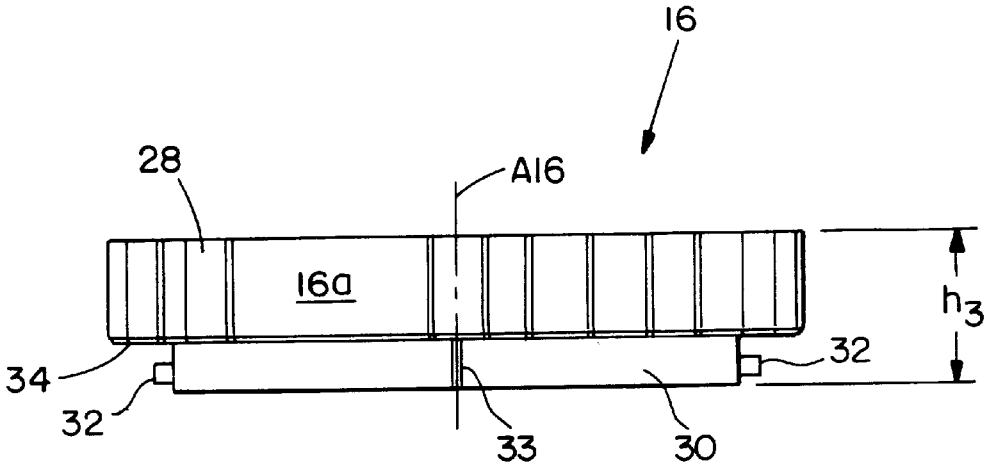
FIG. 6 is a side view of the retaining member.
Figure 7:
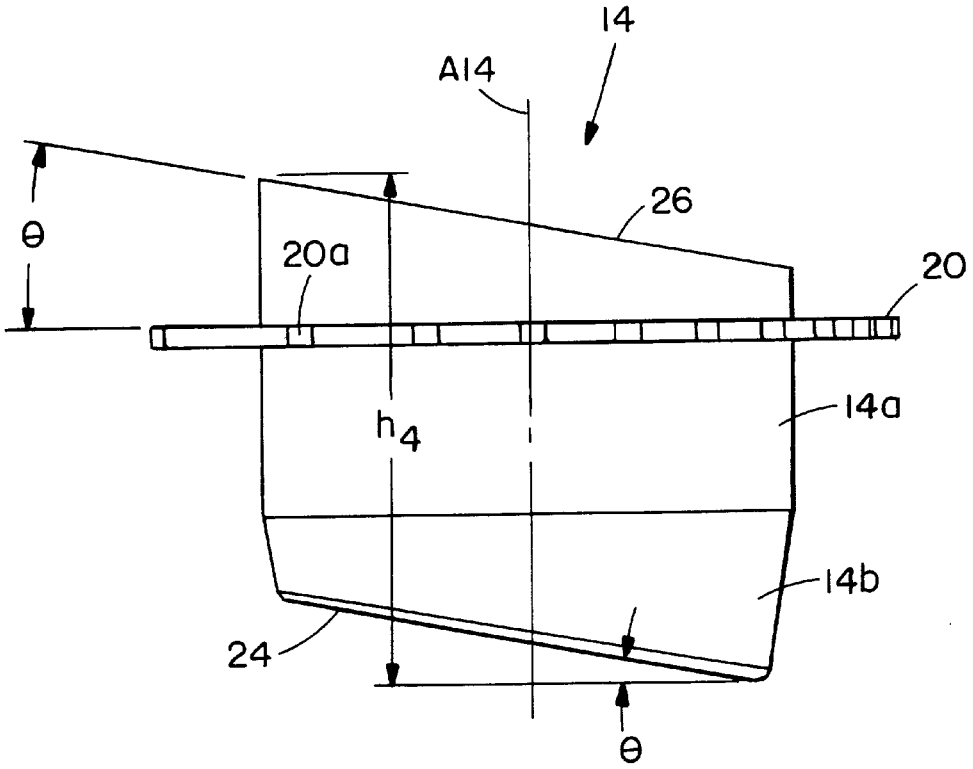
FIG. 7 is a side view of the inner housing.

In one preferred embodiment of transducer assembly 10, flange 36 is preferably at an angle Φ of about 12 degrees (FIG. 4). The height $h_2$ of outer housing 18 is about 2.01 inches and the outer diameter of flange 36 is about 3.68 inches. Retaining member 16 has a height $h_3$ (FIG. 6) of about 0.74 inches and an outside diameter of about 3.57 inches. The height $h_4$ (FIG. 7) of inner housing 14 is about 2.43 inches high and the outside diameter of flange 20 is about 3.57 inches. The lip 26 and the bottom wall 24 are at angles θ of about 10° relative to flange 20. When assembled, the total height $h_1$ (FIG. 1) of transducer assembly 10 in this particular embodiment is about 3.22 inches.

Figure 8:
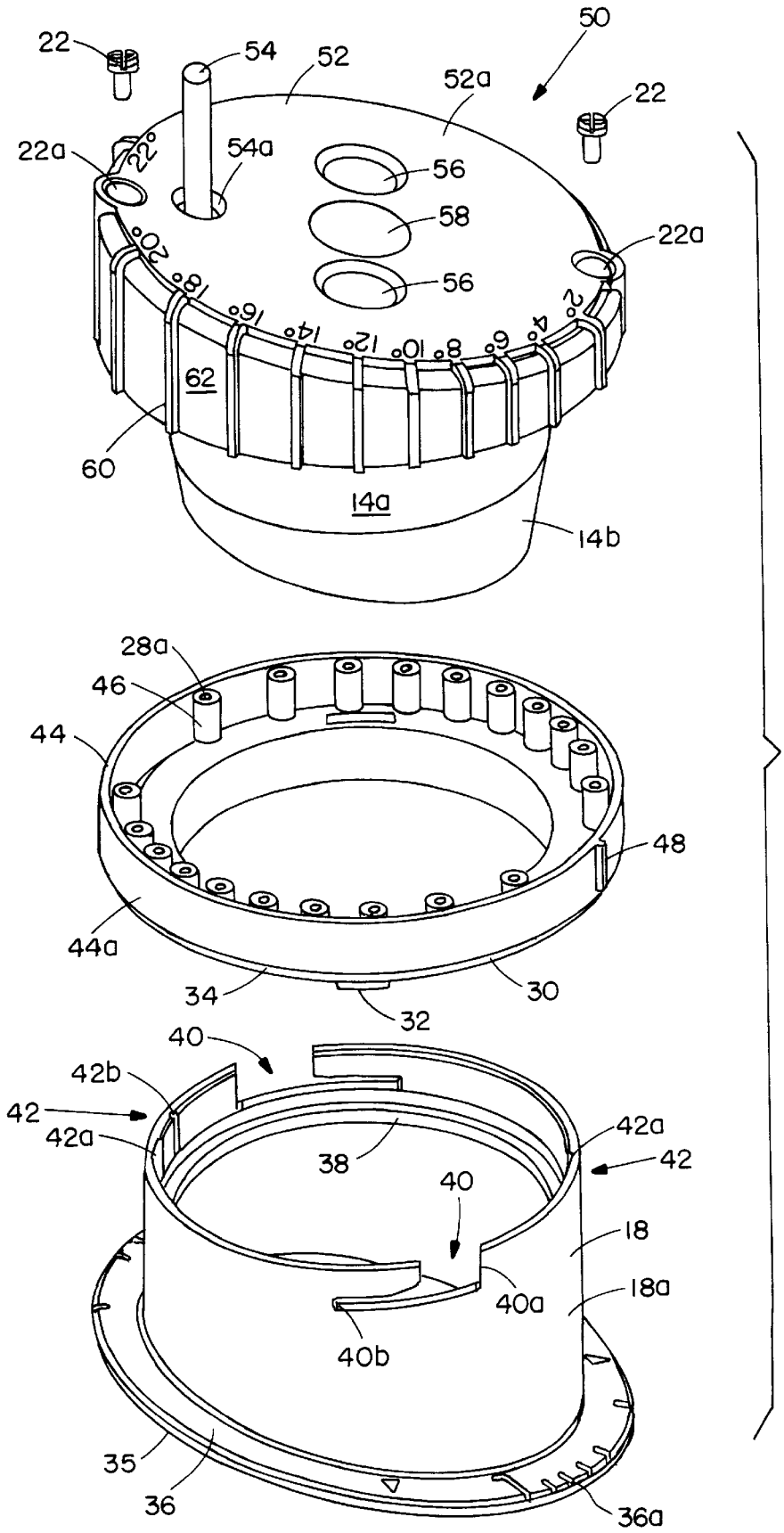
FIG. 8 is an exploded view of another preferred transducer assembly.
Figure 9:
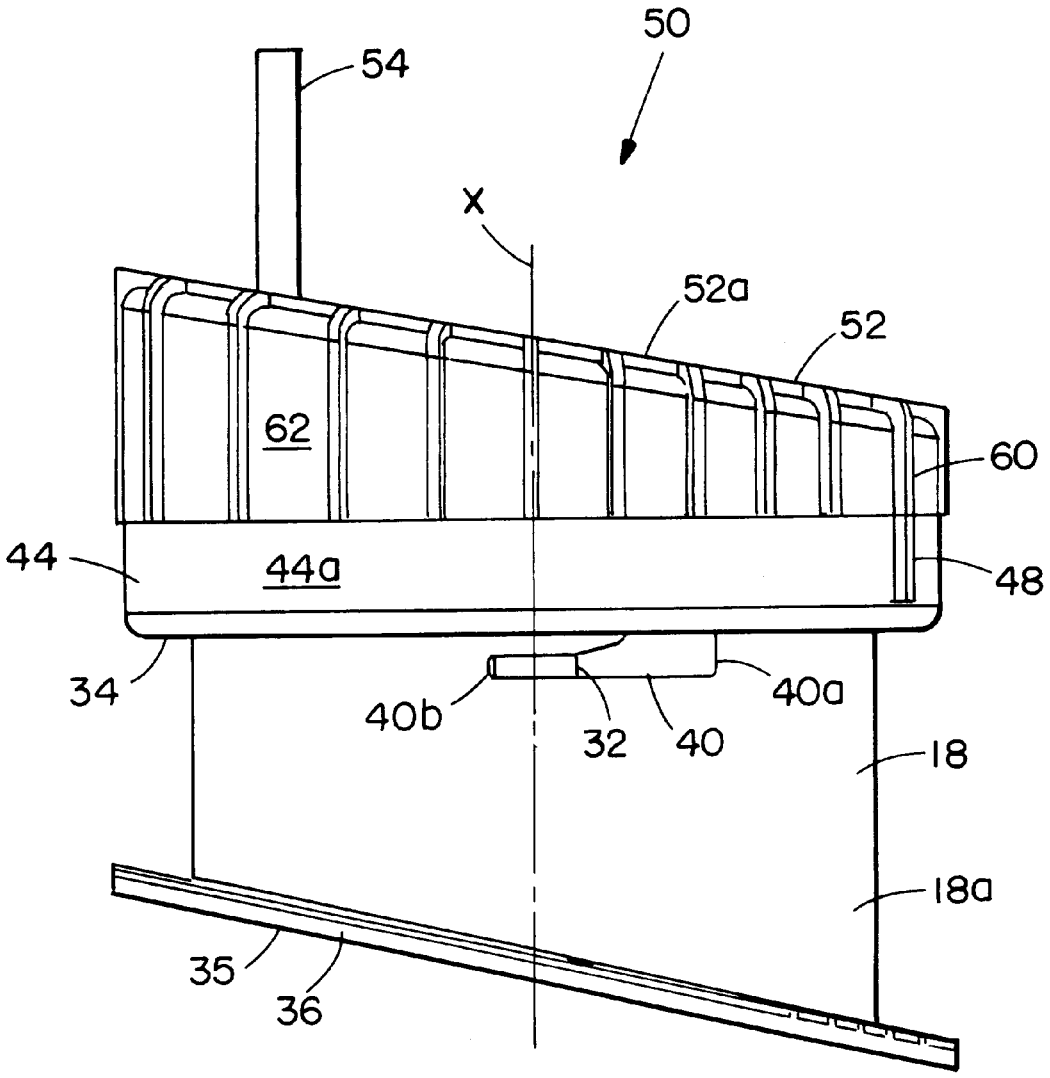
FIG. 9 is a side view of the transducer assembly of FIG. 8.
Figure 10:
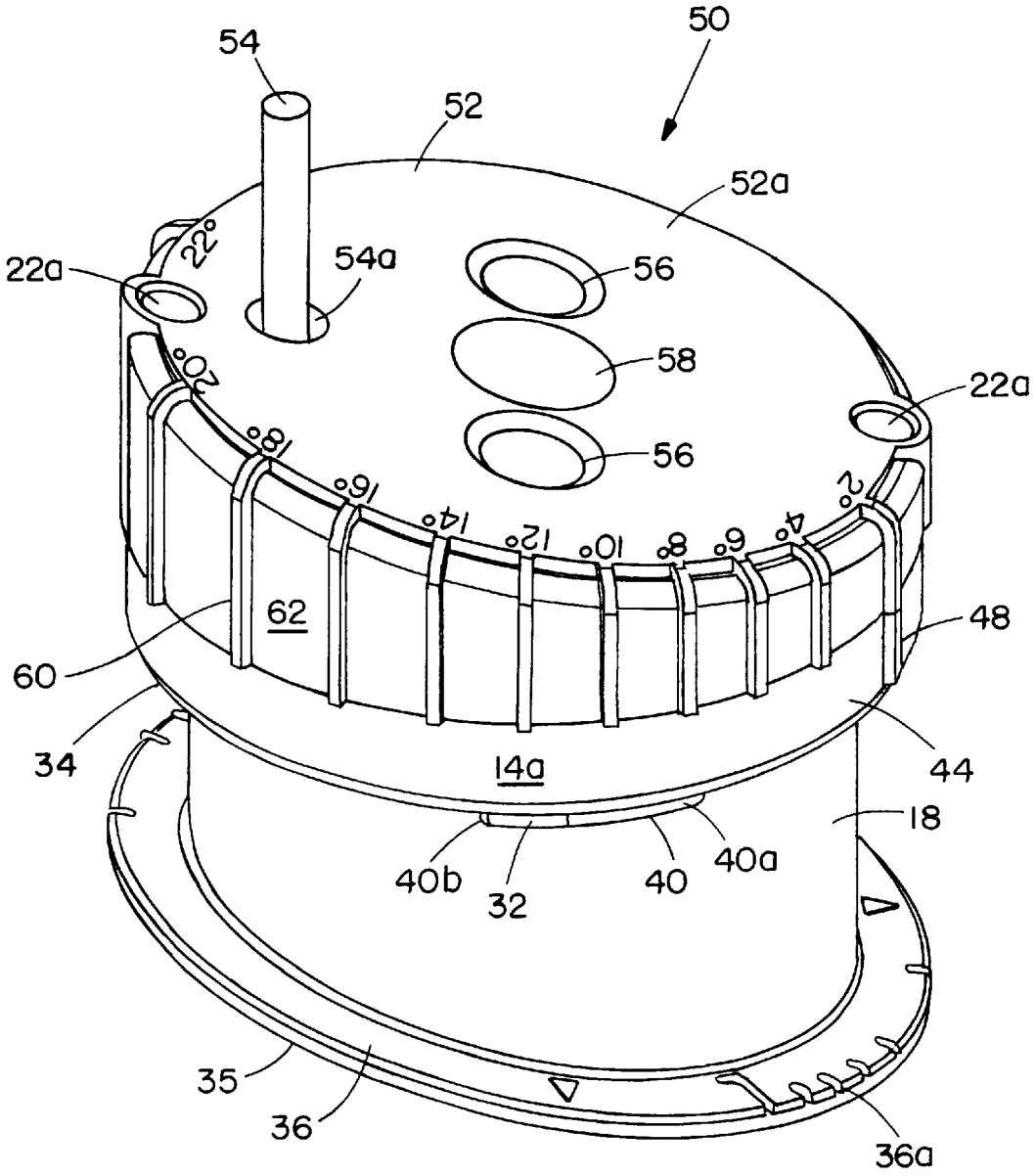
FIG. 10 is a perspective view of the transducer assembly of FIG. 8.

Referring to FIGS. 8, 9 and 10, transducer assembly 50 differs from transducer assembly 10 in that retaining member 44 includes an outer ring portion 44*a* having a series of bosses 46 containing threaded holes 28*a* positioned along the inner perimeter thereof. In addition, inner housing assembly 52 includes a protective top cover 52*a* having an angled top surface and a cylindrical side wall 62 which snaps together with cylindrical portion 14*a*. Top cover 52*a* is angled at the same angle ⊖ as bottom wall 24. A series of ribs 60 with associated hull angle markings extend around the perimeter of side wall 62 for alignment purposes with retaining member 44. Two holes 22*a* extend through top cover 52*a* for securing inner housing assembly 52 to retaining member 44 with screws 22. Cable 54 extends through a hole 54*a* within top cover 52*a*. Hole 54*a* has a radius to prevent damage to cable 54. A pair of holes 56 in top cover 52*a* allow inner housing 52 to be filled with potting material 25 through one hole 56 while the other hole 56 allows air to escape and the height of the potting material 25 to be observed. A central indention 58 within top cover 52*a* is provided to allow the use of a ball bearing to be placed thereon for a leveling purposes if needed.

Equivalents

While this invention has been particularly shown and described with references to preferred embodiments thereof, it will be understood by those skilled in the art that various changes in form and details may be made therein without departing from the spirit and scope of the invention as defined by the appended claims.

For example, although transducer assemblies 10 and 50 have been shown to have incremental angle adjustments, alternatively, such adjustment arrangements can be substituted for a system that is infinitely adjustable. One such infinitely adjustment system can include a threaded locking ring or a clamping device for securing the inner housing to the outer housing at any rotational position. In an infinitely adjustable system, a leveling device can be provided on top of the inner housing to aid in the leveling process.

Although outer housing 18 preferably has an angled end 19, alternatively, end 19 can be squared off such as with end 17. In addition, although retaining slots 40 are shown to extend through the wall of outer housing 18, alternatively, retaining slots 40 can be formed only on the inner surface of cylindrical portion 18*a*. Furthermore, retaining members 16 or 44 can be omitted with inner housings 14 or 52 being secured to outer housing 18 with screws.

Although transducer element 27 has been shown to be directly bonded to bottom wall 24, alternatively, transducer element 27 can be raised above the bottom wall 24 with a series of feet with potting material 25 occupying the space therebetween. The transducer element 27 has been shown to have a flat surface 27*a* for generating soundwaves, however, surface 27*a* can be substituted with a contoured surface shaped to generate particular soundwave profiles. Also, although cable 54 has been shown and described to electrically connect transducer element 27 with remotely located electronics, some electronics can be positioned within the inner housing and encapsulated within the potting material. In addition, although axis X has been shown to be at an angle relative to the vertical axis V, if hull angle γ is at the same angle as the flange angle Φ, axes X and V will coincide. Furthermore, although specific dimensions have been given for transducer assembly 10, such dimensions can vary depending upon the application at hand or the size of the transducer element 27 employed.

What is claimed is:

1. A transducer assembly for mounting to an interior surface of a hull comprising:

a base for securing the assembly to the interior surface of the hull;

a mounting member for mounting to the base, the mounting member being rotatably positionable relative to the base about a rotational axis;

a transducer element secured to the mounting member for generating soundwaves that travel in an acute angular direction relative to the rotational axis, rotation of the mounting member relative to the base about the rotational axis changing the direction of travel of the soundwaves.

2. The transducer assembly of claim 1 further comprising a retaining device for locking the mounting member in place relative to the base.

3. The transducer assembly of claim 2 in which the base is an outer housing comprising a generally cylindrical tube extending along said rotational axis and having an angled mounting surface for securing to the interior surface of the hull.

4. The transducer assembly of claim 3 in which the mounting member is an inner housing comprising a generally cylindrical tube extending along said rotational axis, the inner housing having an angled end wall to which the transducer element is acoustically coupled, a portion of the inner housing extending within the outer housing.

5. The transducer assembly of claim 4 further comprising potting material surrounding the transducer element within the inner housing.

6. The transducer assembly of claim 5 further comprising an acoustic coupling medium positioned between the outer housing and the inner housing for acoustically coupling the inner housing to the hull.

7. The transducer assembly of claim 4 in which the inner housing includes alignment markings for aligning the inner housing in proper rotational position with the outer housing and the outer housing includes alignment markings for aligning the outer housing in proper rotational position relative to the hull.

8. The transducer assembly of claim 4 in which the inner housing includes a flange for securing to the retaining device.

9. The transducer assembly of claim 8 in which the retaining device includes protrusions for engaging with recesses in the base for locking thereto.

10. A transducer assembly for mounting to an interior surface of a hull comprising:

a hollow outer housing having an angled mounting surface for securing to the interior surface of the hull;

a hollow inner housing for mounting within the outer housing, the inner housing being rotatably positionable relative to the outer housing about a rotational axis, the inner housing having an angled end wall;

a transducer element for generating soundwaves acoustically secured to the angled end wall of the inner housing such that soundwaves generated by the transducer element travel in an angular direction relative to the rotational axis, rotation of the inner housing relative to the outer housing about the rotational axis changing the direction of travel of the soundwaves; and a retaining device for locking the inner housing in place relative to the outer housing.

11. The transducer assembly of claim 10 further comprising potting material surrounding the transducer element within the inner housing.

12. The transducer assembly of claim 11 further comprising an acoustic coupling medium positioned between the outer housing and the inner housing for acoustically coupling the inner housing to the hull.

13. The transducer assembly of claim 10 in which the inner housing includes a flange for securing to the retaining device.

14. The transducer assembly of claim 13 in which the retaining device includes protrusions for engaging with recesses in the outer housing for locking thereto.

15. A housing assembly for mounting a transducer element to an interior surface of a hull comprising:

a hollow outer housing having an angled mounting surface for securing to the interior surface of the hull;

a hollow inner housing for mounting within the outer housing, the inner housing being rotatably positionable relative to the base about a rotational axis, the inner housing having an angled end wall for acoustically securing the transducer element thereto such that soundwaves generated by the transducer element travel in an angular direction relative to the rotational axis; and a retaining device for locking the inner housing in place relative to the outer housing.

16. A method of mounting a transducer element to an interior surface of a hull comprising the steps of:

securing a base to the interior surface of the hull;

rotatably positioning a mounting member to the base about a rotational axis;

securing a transducer element for generating soundwaves to the mounting member in an orientation such that soundwaves generated by the transducer element travel in an acute angular direction relative to the rotational axis; and locking the mounting member in a desired rotational position relative to the base for directing the soundwaves generated by the transducer element in a desired direction.

17. The method of claim 16 in which the base is an outer housing, the method further comprising the step of providing the outer housing with a generally cylindrical tube extending along said rotational axis and having an angled mounting surface for securing to the interior surface of the hull.

18. The method of claim 17 in which the mounting member is an inner housing, the method further comprising the step of providing the inner housing with a generally cylindrical tube extending along said rotational axis, the inner housing having an angled end wall to which the transducer element is acoustically coupled.

19. The method of claim 18 further comprising the step of surrounding the transducer element within the inner housing with potting material.

20. The method of claim 19 further comprising the step of acoustically coupling the inner housing to the hull with an acoustic coupling medium positioned between the outer housing and the inner housing.

21. The method of claim 18 in which the hull is at an angle, the method further comprising the step of rotationally positioning the outer housing relative to the hull to at least partially compensate for the angle of the hull.

* * * * *